United States Patent [19]

Hayama et al.

[11] 4,408,639

[45] Oct. 11, 1983

[54] COIL MANUFACTURING APPARATUS

[75] Inventors: Yoshihiro Hayama, Fujisawa; Yuukou Hosokawa, Yokosuka, both of Japan

[73] Assignee: Tokyo Shibaura Denki Kabushiki Kaisha, Kawasaki, Japan

[21] Appl. No.: 220,235

[22] Filed: Dec. 23, 1980

[30] Foreign Application Priority Data

Dec. 26, 1979 [JP] Japan ..... 54-169784
May 14, 1980 [JP] Japan ..... 55-63636

[51] Int. Cl.[3] ..... B21F 3/04
[52] U.S. Cl. ..... 140/71.5; 72/66
[58] Field of Search ..... 140/71.5; 72/66; 242/7.09, 7.13, 7.14

[56] References Cited

U.S. PATENT DOCUMENTS 3,124,169 3/1964 Schade ..... 140/71.5
3,252,485 5/1966 Kelly ..... 140/71.5
3,322,164 5/1967 Lindsay ..... 140/71.5
3,605,822 9/1971 Noguchi et al. ..... 140/71.5

FOREIGN PATENT DOCUMENTS 45-32789 12/1970 Japan .
800929 9/1958 United Kingdom ..... 140/71.5

*Primary Examiner*—Lowell A. Larson
*Attorney, Agent, or Firm*—Cushman, Darby & Cushman

[57] ABSTRACT

A coil manufacturing apparatus comprises a mandrel wire, a guide for guiding the mandrel wire in its longitudinal movement, a coiling device guiding a filament wire while revolving around the mandrel wire to coil the filament wire around the mandrel wire, and a transfer device for moving the mandrel wire along the longitudinal direction thereof. The transfer device includes holding jaws to hold only the mandrel wire and driving screws for moving the holding jaws along the longitudinal direction from a first position to a second position which is farther from the guide than the first position is.

9 Claims, 12 Drawing Figures

COIL MANUFACTURING APPARATUS

This invention relates to a coil manufacturing apparatus, more specifically to a coil manufacturing apparatus for shaping a filament into the form of a coil.

A prior art coil manufacturing apparatus comprises a mandrel wire, guide means for guiding the mandrel wire in its longitudinal movement, a coiling head guiding a filament wire for a coil while revolving around the mandrel wire to coil the filament wire around the mandrel wire, and transfer means for moving the mandrel wire along the longitudinal direction thereof at a speed corresponding to the number of revolutions of the coiling head. In the prior art apparatus, the guide means is constructed of a nozzle, and the transfer means has a drum. The drum rotates with a number of revolutions corresponding to the number of revolutions of the coiling head, and moves the mandrel wire along the longitudinal direction by winding the mandrel wire on the outer peripheral surface of itself. A coil with a fixed pitch is formed from the filament wire on the mandrel wire by suitably setting the ratio between the number of revolutions of the coiling head and that of the drum. If slipping is caused between the mandrel wire and the drum, the coil pitch will fall into disorder, and the slide-contact regions of the coil that slide on the mandrel wire will be damaged. Further, frictional force developed between the coil and the outer peripheral surface of the drum will damage the slide-contact regions of the coil that slide on the other peripheral surface. More further, to form straight line shaped leg sections at the both ends of the coil is difficult owing to a spring-back at the leg sections and a deformation of the leg sections caused by a heat treatment for releasing strain produced at a coil forming.

The object of this invention is to provide a coil manufacturing apparatus that free from disordered coil pitch and damage to coil, and can forms leg sections at the both ends of the coil.

This invention can be more fully understood from the following detailed description when taken in conjunction with the accompanying drawings, in which.

Now an embodiment of this invention will be described with reference to the accompanying drawings.

Figure 1:
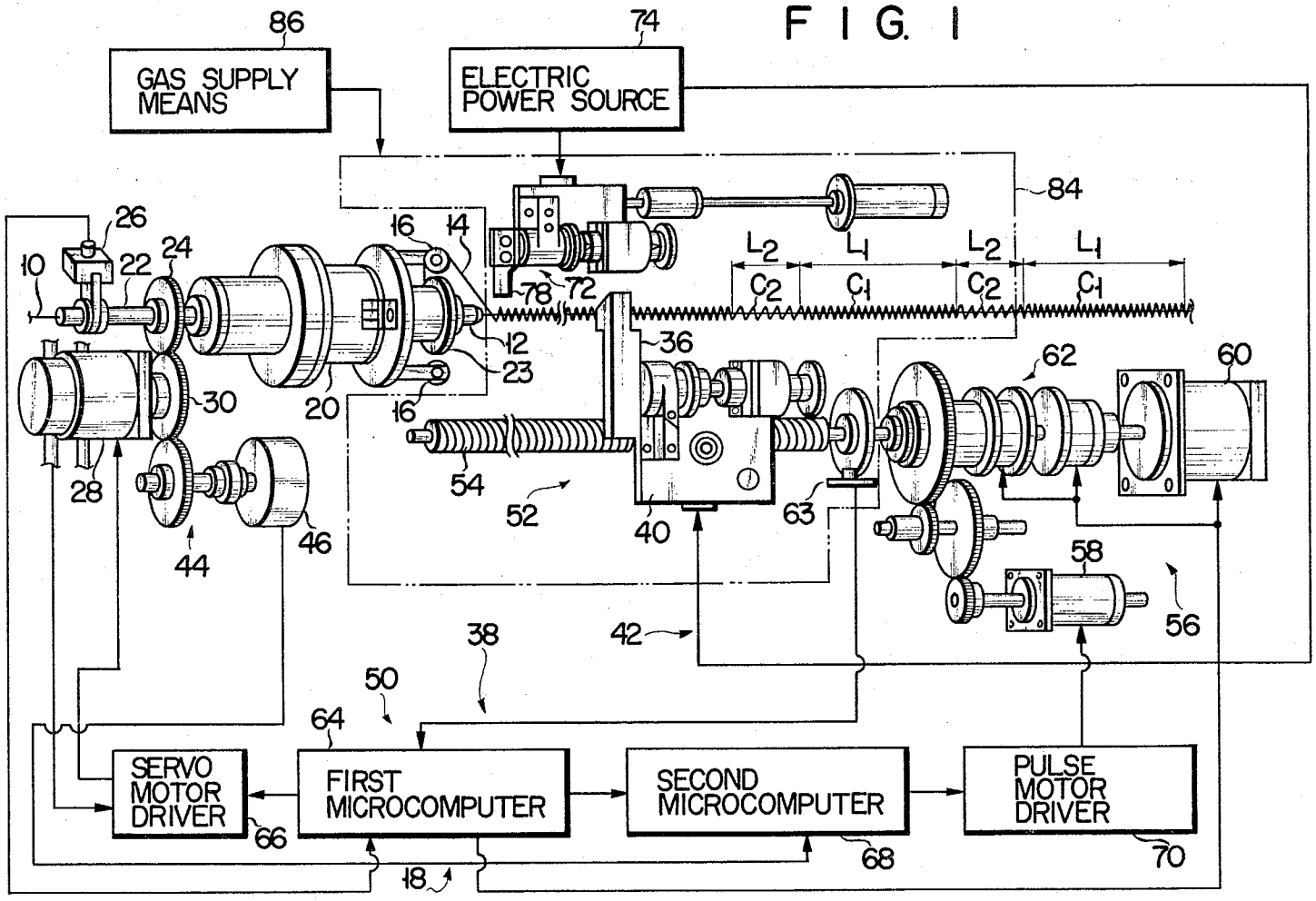
FIG. 1 is a plan view schematically showing the construction of an apparatus according to an embodiment of this invention.

FIG. 1 schematically shows an embodiment of this invention.

The apparatus of this embodiment comprises guide means 12 for guiding a mandrel wire 10 in its longitudinal movement, coiling means 16 guiding a filament wire 14 for a coil while revolving around the mandrel wire 10 to coil the filament wire 14 around the mandrel wire 10, and transfer means 18 for moving the mandrel wire 10 along the longitudinal direction thereof.

In this embodiment, the coiling means 16 is a guide roller coupled with a coiling head 20 which is disposed concentrically with the mandrel wire 10 and rotates on the mandrel wire 10 as its axis. A pipe 22 for guiding the mandrel wire 10 is passed through the central axis of the coiling head 20, and is fixed to the coiling head 20. In this embodiment, the guide means 12 is a nozzle attached to one end of the pipe 22. The filament wire 14 is wound on a bobbin 23 which is mounted concentrically with the mandrel wire 10 on the coiling head 20 that rotates with a suitable torque. After drawn out from the bobbin 23 onto the coiling means 16, the filament wire 14 is coiled around the mandrel wire 10 by the coiling means 16 which revolves around the mandrel wire 10.

As shown in FIG. 1, the other end portion of the pipe 22 is fixed with a gear 24 and a rotation position detector 26 which detects the circumferential position of the coiling head 20 and produces a circumferential position signal corresponding to the detected circumferential position. The gear 24 engages a gear 30 which is fixed on the output shaft of a servomotor 28, and the coiling head 20 is rotated by the servomotor 28.

The transfer means 18 includes holding means 36 for holding only the mandrel wire 10, and driving means 38 for moving the holding means 36 along the longitudinal direction of the mandrel wire 10 from a first position to a second position which is farther from the guide means 12 than the first position is.

In this embodiment, the holding means 36 is formed of a chuck which is sustained by a carriage member 40. The transfer means 18 is provided with variable-speed driving means 42 for moving the carriage member 40 from the first position to the second position at a variable speed corresponding to the number of revolutions of the coiling means 16.

The variable-speed driving means 42 has revolution detecting means 44 which produces an electrical revolution signal corresponding to the revolutional angle of the coiling means 16. In this embodiment, the revolution detecting means 44 is a first encoder 46. The input shaft of the first encoder 46 is fixed with a gear 48 which engages the gear 30 of the servomotor 28. The first encoder 46 detects the revolutional angle of the coiling head 20, or that of the coiling means 16, by detecting the revolutional angle of the output shaft of the servomotor 28, and produces an electrical revolution signal corresponding to the revolutional angle of the coiling means 16.

Further, the variable-speed driving means 42 is provided with coil pitch control means 50 which produces one of various electrical coil pitch signals in response to the revolution signal. Also, the variable-speed driving means 42 includes variable-speed transfer means 52 which receives the coil pitch signal and moves the carriage member 40 from the first position to the second position at a speed corresponding to the coil pitch signal.

The variable-speed transfer means 52 has a screw member 54 disposed along the longitudinal direction of the mandrel wire 10 and connected to a driving source 56 for rotation. The driving source 56 rotates with a number of revolutions corresponding to the coil pitch signal to cause the screw member 54 to rotate with a number of revolutions corresponding to the coil pitch signal. The screw member 54 engages the carriage member 40 to move by its own rotation the carriage member 40 from the first position to the second position along the longitudinal direction of the mandrel wire 10.

Figure 2:
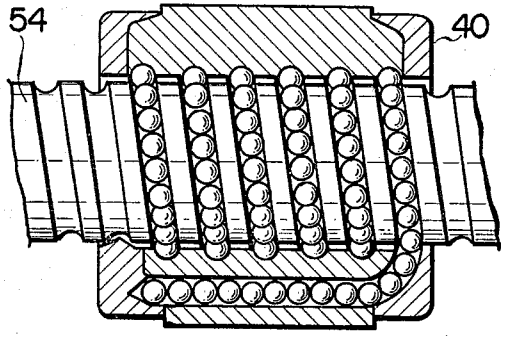
FIG. 2 is a sectional view showing the construction of a carriage member and a screw member shown in FIG. 1.

As shown in FIG. 2, the carriage member 40 has a ball-screw nut to mate with the screw member 54.

The driving source 56 is provided with a first motor 58 which receives the coil pitch signal and rotates at a speed corresponding to the coil pitch signal. In this embodiment, the first motor 58 is a pulse motor. The driving source 56 is further provided with a second motor 60, as well as clutch means 62 which is connected with the first and second motors 58 and 60 and the screw member 54 and alternatively transmits the rotation of the first or second motor 58 or 60 to the screw member 54. When the clutch means 62 transmits the rotation of the first motor 58 to the screw member 54, the screw member 54 rotates in one direction to move the carriage member 40 from the first position to the second position. On the other hand, when the clutch means 62 transmits the rotation of the second motor 60 to the screw member 54, the screw member 54 rotates in the other direction to move the carriage member 40 from the second position to the first position. The second motor 60 is a conventional motor which rotates the screw member 54 in the other direction with a relatively large fixed number of revolutions per unit time by the action of the clutch means 62. Accordingly, the moving speed of the carriage member 40 moving from the second position to the first position is higher than that of the carriage member 40 moving from the first position to the second position.

The screw member 54 is provided with a second encoder 63 for detecting the number of revolutions of the screw member 54 to detect the moved distance of the carriage member 40.

The coil pitch control means 50 includes a first microcomputer 64 and a servomotor driver 66 which is controlled by the first microcomputer 64 to control the rotation of the servomotor 28. The coil pitch control means 50 further includes a second microcomputer 68 and a pulse motor driver 70 which is controlled by the second microcomputer 68 to control the rotation of the first motor 58. In this embodiment, the rotation of the second motor 60 is controlled by the first microcomputer 64.

In this embodiment, the holding means 36 and the mandrel wire 10 have electrically conductive nature. Disposed between the holding means 36 and the guide means 12 is terminal means 72 to contact with the mandrel wire 10 and the filament wire 14. Having electrically conductive nature, the terminal means 72 is to be electrically contacted with the mandrel wire 10 and the filament wire 14. The terminal means 72 and the holding means 36 are electrically connected with electric power source means 74. The electric power source means 74 supplies current to an electric path including terminal means 72, holding means 36, and the filament wire 14 when the mandrel wire 10 and the filament wire 14 is electrically connected with the terminal means 72. At this time, the filament wire 14 coiled around the mandrel wire 10 is treated with heat between the terminal means 72 and the holding means 36. The heat-treated filament wire 14 coiled around the mandrel wire 10 is cleared of working strain.

In the embodiment, as shown in FIG. 1, the terminal means 72 is another holding means 78 to hold only the mandrel wire 10 between the filament wire 14 coiled on the mandrel wire 10 and the guide means 12. The another holding means 78 has the same construction as the holding means 36.

Figure 3:
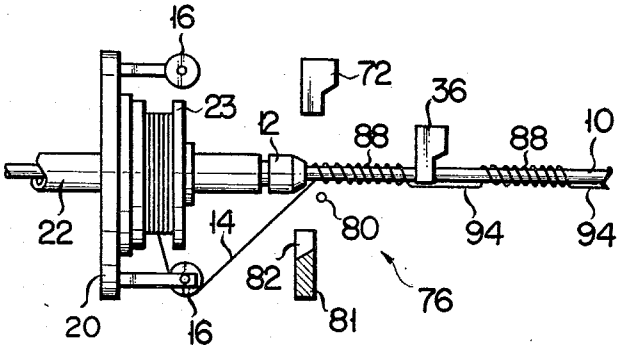
FIG. 3 is an enlarged plan view schematically showing the construction in the vicinity of a coiling head and guide means shown in FIG. 1.
Figure 4:
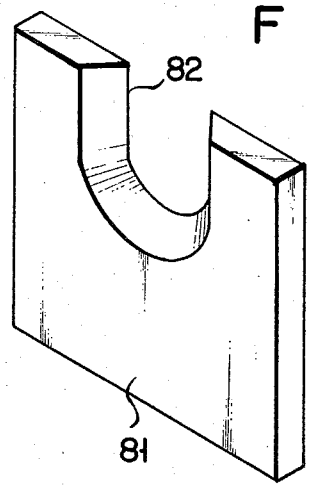
FIG. 4 is a perspective view of a forming knife shown in FIG. 3.

As shown in FIG. 3, the apparatus of this embodiment is provided with a cylindrical guide pin 80 beside the mandrel wire 10 in the vicinity of the guide means 12 and a forming knife 81 below the guide pin 80. As shown in FIG. 4, the forming knife 81 has a U-shaped notch 82 on its top end face. The forming knife 81 is brought close to the guide means 12 only when the filament wire 14 is initially coiled around the mandrel wire 10, allowing the path of the filament wire 14 between the coiling means 16 and the mandrel wire 10 to be located in the notch 82. Such position is to be defined as a first position of the forming knife 81. The forming knife 81 may be moved away from the guide means 12, as shown in FIG. 3, causing the path of the filament wire 14 to be separated from the notch 82. Such position is to be defined as a second position of the forming knife 81.

The apparatus of this embodiment is provided with housing means 84 to house the filament wire 14 which is coiled around the mandrel wire 10 between the holding means 36 and the another holding means 78 when these holding means 36 and 78 are electrically connected with the mandrel wire 10. Further, the apparatus includes gas supply means 86 which supplies and fills the housing means 84 with gas containing inert gas. In this embodiment, the gas contains hydrogen.

Now there will be described the operation of the apparatus of the above-mentioned embodiment. While the holding means 36 is holding the mandrel wire 10, the first microcomputer 64 controls the servomotor driver 66 to rotate the servomotor 28 in one direction with a fixed number of revolutions. Then, the coiling head 20, or coiling means 16, rotates in one direction with a fixed number of revolutions to coil the filament wire 14 around the mandrel wire 10. At this time, the first encoder 46 produces an electrical revolution signal corresponding to the number of revolutions of the servomotor 28, that is, the number of revolutions of the coiling means 16 around the mandrel wire 10. The revolution signal is supplied to the second microcomputer 68. The second microcomputer 68 produces one of various electrical coil pitch signals in response to the revolution signal. The coil pitch signal is supplied to the pulse motor driver 70. The pulse motor driver 70 rotates the first motor 58 with a number of revolutions corresponding to the supplied coil pitch signal. When the servomotor 28 is rotated in one direction with a fixed number of revolutions, the first microcomputer 64 controls the clutch means 62 to transmit the rotation of the output shaft of the first motor 58 to the screw member 54. Then, the screw member 54 rotates in one direction with a fixed number of revolutions, so that the holding means 36 sustained by the carriage member 40 moves away from the guide means 12, that is, from the first position toward the second position, at a speed corresponding to the coil pitch signal.

Because the coiling head 20 rotates with a fixed number of revolutions and at the same time the holding means 36 moves away from the guide means 12 with a speed corresponding to the coil pitch signal, the filament wire 14 is coiled around the mandrel wire 10 between the holding means 36 and the guide means 12 at fixed regular pitches.

Meanwhile, the first microcomputer 64 operates the revolution signal produced by the first encoder 46 and the circumferential position signal produced by the rotation position detector 26, thereby calculating the number of turns of the filament wire 14 around the mandrel wire 10. The number of turns of the filament wire 14 can be calculated by only the first encoder 46. By the combined use of the rotation position detector 26 with the first encoder 46, however, any number of turn less than one, such as $\frac{1}{2}$, $\frac{1}{3}$ or $\frac{1}{4}$, can also be calculated.

In the meantime, the second encoder 63 supplies the first microcomputer 64 with an electrical revolution signal corresponding to the number of revolutions of the screw member 54, that is, the moved distance of the carriage member 40.

Accordingly, the coil pitch control signal produced by the second microcomputer 68 can be changed in response to the moved distance of the carriage member 40 by previously loading the first microcomputer 64 with a prescribed program. For example, the carriage member 40 is first caused to travel over a fixed distance $L_1$ (hereinafter referred to as first distance) at a moving speed (hereinafter referred to as first moving speed) in accordance with a first coil pitch signal produced by the second microcomputer 68 while the coiling head 20 has been rotated in one direction. In this time, the filament wire 14 is coiled around the mandrel wire 10 at pitches. Thereafter, the first coil pitch signal from the second microcomputer 68 is changed into a second coil pitch signal by the action of the program in the first microcomputer 64. Receiving the second coil pitch signal, the pulse motor driver 70 rotates the first motor 58 at a rotation speed corresponding to the second coil pitch signal which is, for example, higher than a rotation speed corresponding to the first coil pitch signal. As a result, the carriage member 40 moves away from the guide means 12 at a moving speed (hereinafter referred to as second moving speed) higher than the first moving speed. The movement of the carriage member 40 at the second moving speed causes the filament wire 14 to be coiled around the mandrel wire 10 at greater pitches than the aforesaid fixed pitches. Informed from the second encoder 63 that the carriage member 40 has moved at the second moving speed over a second distance $L_2$ as shown in FIG. 1, the first microcomputer 64 changes the second coil pitch signal from the second microcomputer 68 into the first coil pitch signal in accordance with the prescribed program. Then, the carriage member 40 moves away from the guide means 12 at the first moving speed corresponding to the first coil pitch signal, as aforesaid. At this time, the filament wire 14 is coiled around the mandrel wire 10 at the fixed pitches.

By repeating the above-described operations in accordance with the prescribed program, first-pitch sections $C_1$ each extending over the first distance $L_1$ at the pitches and second-pitch sections $C_2$ each extending over the second distance $L_2$ at the pitches greater than the former can be alternately formed on the mandrel wire 10, as shown in FIG. 1.

Figure 6:
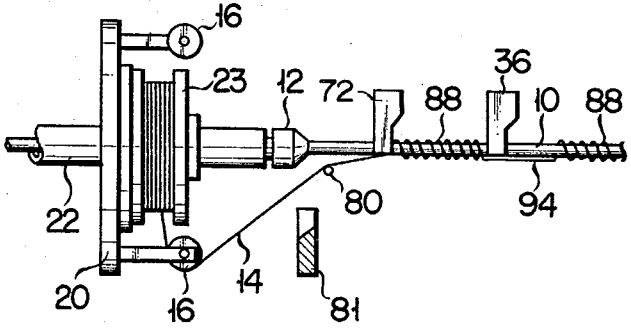
FIG. 6 is a plan view showing a state in which the mandrel wire is moved over a distance for making a gap having a prescribed length and to be chucked by holding means during the coiling head stops its rotation.
Figure 5:
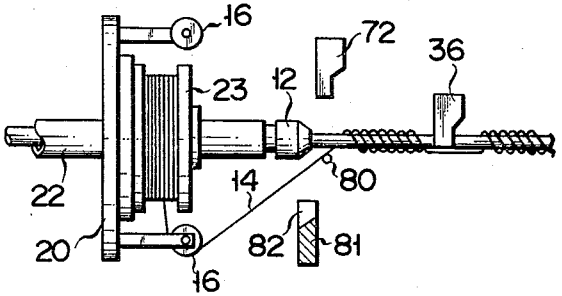
FIG. 5 is a plan view showing a state in which coiling of a filament wire around a mandrel wire shown in FIG. 3 is finished.

Informed from the first encoder 46 that the predetermined number of turns of the filament wire 14 is achieved, the first microcomputer 64 controls the servomotor driver 66 to stop the rotation of the servomotor 28. At this time, the first microcomputer 64 operates the circumferential position signal from the rotation position detector 26 and the revolution signal from the first encoder 46, and stops the rotation of the coiling head 20 so that the coiling means 16 guiding the filament wire 14 may be located right under the mandrel wire 10. When the coiling head 20 ceases to rotate, the first microcomputer 64 supplies the second microcomputer 68 with an instruction to stop the coil pitch signal. Receiving the instruction for stopping the coil pitch signal, the second microcomputer 68 stops the rotation of the first motor 58, or the movement of the carriage member 40. After that, the second microcomputer 64 controls the pulse motor driver 70 to rotates the first motor 58 at a prescribed number of revolution for making a gap having a prescribed length and to be chucked by holding means 78 at the end of the coil shaped filament wire 14 by a prescribed amount of movement of the carriage member 40. Achieving the prescribed number of revolution, the first motor 58 stops its rotation by an instruction of the second microcomputer 68. Since the mandrel wire 10 is moved along its longitudinal direction over a prescribed distance by the holding means 36 moving over a prescribed distance with the carriage member after the time when the rotation of the coiling head 20 is stopped, the guide means side end of the coil shaped filament wire 14, which is coiled around the mandrel wire 10 to be shaped into the form of a coil, is separated at a fixed distance from the guide means 12. FIG. 5 shows this state. Then the holding means 78 controlled by the first microcomputer 64 chucks the mandrel wire 10. Confirming the above action by the first microcomputer 64 the first microcomputer 64 supplies the second microcomputer 68 with an instruction to rotate the first motor 58 and to carry the holding means 36 over the distance corresponding to the length of the leg section in the longitudinal direction. FIG. 6 shows this state.

As shown in FIG. 6, the guide pin 80 contacts the filament wire 14 between the aforesaid end of the coiled shaped filament wire 14 and the coiling means 16. Between the end and the guide means 12, the filament wire 14 forms a leg section 94 extending in a straight line along the mandrel wire 10. The leg section 94 is spaced from the terminal means 72.

Figure 7:
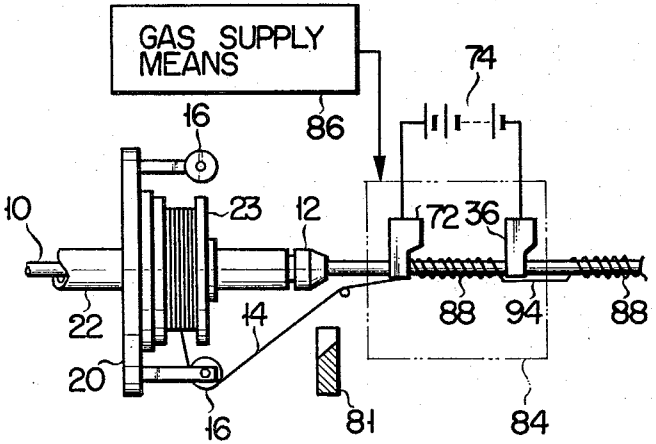
FIG. 7 is a plan view showing how the filament wire coiled around the mandrel wire of FIG. 6 is treated with heat.

Then, as shown in FIG. 7, the terminal means 72 holds the mandrel wire 10 between the aforesaid end of the coil shaped filament wire 14 and the guide means 12. At the same time, the filament wire 14 coiled around the mandrel wire 10 between the terminal means 72 and the holding means 36 is housed in the housing means 84. The housing means 84 is supplied and filled with gas containing hydrogen and inert gas from the gas supply means 86.

Then, as shown in FIG. 7, the electric path including the holding means 36, terminal means 72, and mandrel wire 10 is supplied with current from the electric power source means 74. Thereupon, the filament wire 14 coiled around the mandrel wire 10 between the holding means 36 and the terminal means 72 is treated with heat, so that working strain produced when the filament wire 14 is shaped into the form of a coil is released. Heat-treated in the aforesaid gas, the filament wire 14 can maintain its fine external appearance without suffering oxidation.

Subsequently, the holding means 36 releases its hold on the mandrel wire 10 and then the operation of the clutch means 62 is changed by an instruction from the first microcomputer 64. Namely, the coupling between the first motor 58 and the screw member 54 is released, and the second motor 60 is coupled with the screw member 54.

Figure 8:
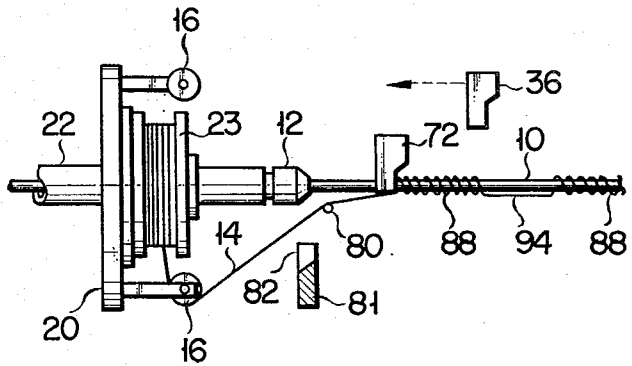
FIGS. 8 to 11 are plan views successively showing steps of newly coiling the filament wire around the mandrel wire after the heat treatment of FIG. 7.

Then, the second motor 60 is rotated at a higher speed by the first microcomputer 64 to rotate the screw member 54 in the other direction with a relatively large fixed number of revolutions per unit time. At this time, the carriage member 40, or the holding means 36, moves from the second position to the first position, that is, toward the guide means 12, at a moving speed higher than the moving speed at which it moves away from the guide means 12. FIG. 8 shows this state.

Then, the first microcomputer 64 is informed that the carriage member 40, or the holding means 36, has reached its first position near the guide means 12 through an electrical moved distance detection signal produced by the second encoder 63. Thereupon, the first microcomputer 64 stops the rotation of the second motor 60 and changes the action of the clutch means 62. Namely, the coupling between the second motor 60 and the screw member 54 is released, and the first motor 58 is coupled with the screw member 54. In this time, the holding means 36 does not chucks the mandrel wire 10, and the terminal means 72 chuck the mandrel wire 10 and does not move from its position by a magnet (not shown) controlled by the first microcomputer 64.

Figure 9:
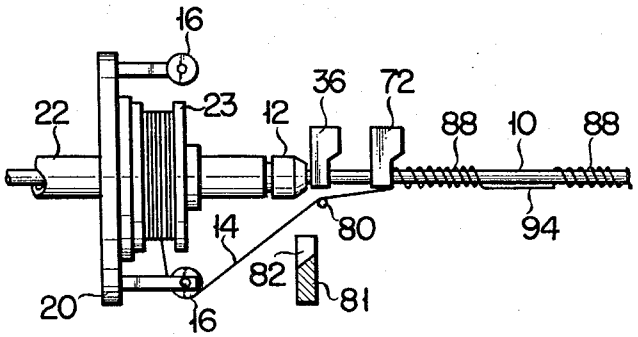

Subsequently, as shown in FIG. 9, the holding means 36 is caused to hold the mandrel wire 10 between the guide means 12 and the terminal means 72.

Figure 10:
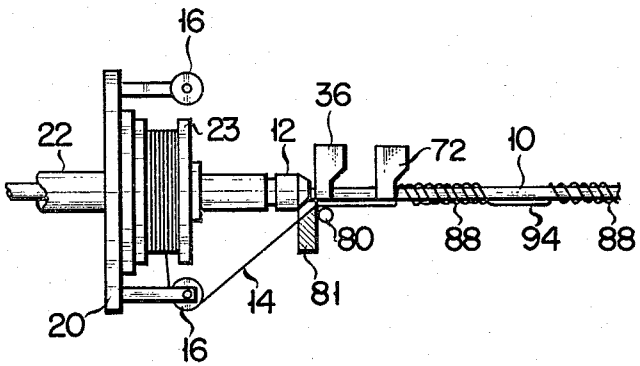

Then, as shown in FIG. 10, the forming knife 81 is located in the second position. At this time, the filament wire 14 between the guide pin 80 and the coiling means 16 is located within the notch 82 of the forming knife 81.

Figure 11:
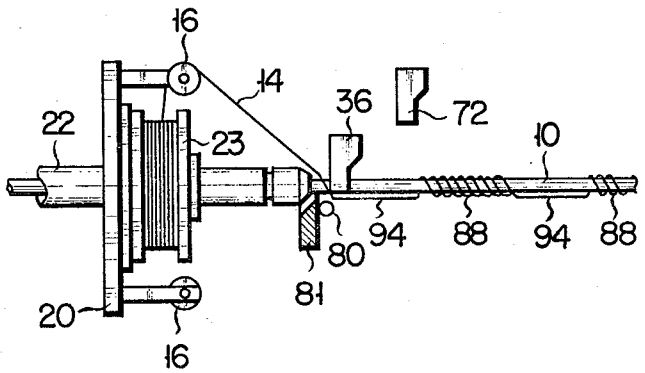

Then, the servomotor 28 is rotated in one direction with a fixed number of revolutions by the first microcomputer 22, and the carriage member 40, or the holding means 36, is started running from the first position toward the second position, that is, away from the guide means 12, at a speed corresponding to the pitch. The forming knife 81 moves from the second position shown in FIG. 11 to the first position shown in FIG. 3 and the terminal means 72 is separated from the mandrel wire 10 when the filament wire 14 is wound around the mandrel wire 10 a few turns.

By repeating the above-described procedures, the coil section 88 with a fixed length can be continuously formed until the supply of the core wire 10 from the guide means 12 is stopped.

Thereafter, a plurality of such continuously formed coil sections 88 are separated from one another to form separate coil sections, and the mandrel wire 10 is cleared.

As described above, the coil manufacturing apparatus of this invention comprises a mandrel wire, guide means for guiding the mandrel wire in its longitudinal movement, coiling means guiding a filament wire while revolving around the mandrel wire to coil the filament wire around the mandrel wire, and transfer means for moving the mandrel wire along the longitudinal direction thereof, characterized in that the transfer means includes holding means to hold only the mandrel wire and driving means for moving the holding means along the longitudinal direction from a first position to a second position which is farther from the guide means than the first position is.

With such construction, there will be caused neither disordered coil pitches nor damage to the coils produced.

The coil manufacturing apparatus of this invention is preferably so constructed that the driving means includes a carriage member sustaining the holding means and variable-speed driving means for moving the carriage member from the first position to the second position at a variable-speed corresponding to the number of revolutions of the coiling means.

With such construction, the coil pitch may be set variably.

The coil manufacturing apparatus of this invention is preferably so constructed that the variable-speed driving means includes revolution detecting means producing an electrical revolution signal corresponding to the number of revolutions of the coiling means, coil pitch control means receiving the electrical revolution signal and producing one of various electrical coil pitch signals in response to the electrical revolution signal, and variable-speed transfer means receiving the electrical coil pitch signal and moving the carriage member from the first position to the second position at a speed corresponding to the electrical coil pitch signal.

Such construction facilitates setting of various coil pitches as compared with a construction in which a carriage member is coupled with variable-speed driving means by means of a series of gears. Further, the influence of gear backlash will be reduced to improve the accuracy of coil pitch.

Moreover, the coil manufacturing apparatus of this invention is preferably so constructed that the variable-speed transfer means includes a screw member disposed along the longitudinal direction and mating with the carriage member, and a driving source for rotation coupled with the screw member and receiving the electrical coil pitch signal to rotate with a number of revolutions corresponding to the electrical coil pitch signal, whereby the screw member is rotated with a number of revolutions corresponding to the electrical coil pitch signal.

With such construction, the structure of the variable-speed transfer means may be simplified, and the maintenance may be facilitated to ensure reliable operation of the apparatus.

The coil manufacturing apparatus of this invention is preferably so constructed that the carriage member has a ball-screw nut to mate with the screw member.

Such construction may provide a feed screw with zero backlash and extremely small coefficient of friction, so that the accuracy of coil pitch will be improved as compared with the prior art apparatus.

Further, the coil manufacturing apparatus of this invention is preferably so constructed that the driving source for rotation is a pulse motor.

The coil manufacturing apparatus of this invention is preferably so constructed that the driving source for rotation includes a first motor receiving the electrical coil pitch signal to rotate at a speed corresponding to the electrical coil pitch signal, a second motor, and clutch means coupled with the screw member, the first, and second motors and alternatively transmitting the rotation of the first or second motor to the screw member, so that the screw member is rotated in one direction to move the carriage member from the first position to the second position when the rotation of the first motor is transmitted to the screw member, and that the screw member is rotated in the other direction to move the carriage member from the second position to the first position when the rotation of the second motor is transmitted to the screw member.

With such construction, the time required for the movement of the carriage member from the second position to the first position may be reduced, so that the apparatus can be improved in its productivity.

Moreover, the coil manufacturing apparatus of this invention is preferably so constructed that the holding means and the mandrel wire have electrically conductive nature, and further comprises terminal means having electrically conductive nature and electrically connected with either the mandrel wire or the filament wire between the holding means and the guide means, and electric power source means electrically connected with the terminal means and the holding means and supplying current to an electric path including the terminal means, the holding means, and the filament wire when the mandrel wire or the filament wire is electrically connected with the terminal means, thereby heat-treating the filament wire coiled around the mandrel wire between the terminal means and the holding means so that working strain may be removed from the filament wire coiled around the mandrel wire.

With such construction, the filament wire coiled around the mandrel wire in the form of a coil may be cleared of any working strain. As compared with the case of the prior art apparatus in which heat treatment is conducted in a condition that the both ends of the coil does not be chucked by holding means, therefore, the disorder in coil pitches due to the heat treatment can be reduced, and the straight configuration of the leg section of the coil shaped filament wire as shown in FIGS. 3 to 10 will never be damaged by the heat treatment. Accordingly, there will be required no process for correcting the shape of the leg section into the straight after the heat treatment.

The coil manufacturing apparatus of this invention preferably further comprises housing means to house the filament wire coiled around the mandrel wire between the holding means and the terminal means when the terminal means is electrically connected with the mandrel wire or the filament wire, and gas supply means for supplying and filling the housing means with gas containing inert gas.

With such construction, the filament wire can be prevented from being oxidized during the heat treatment, so that the coil can maintain its fine external appearance to improve its value as a product. Moreover, there will be required no process for reduction after the heat treatment.

The coil manufacturing apparatus of this invention is preferably so constructed that the gas contains hydrogen.

Such construction strengthen the prevention of oxidation of the filament wire during the heat treatment and hence the maintenance of external appearance.

The coil manufacturing apparatus of this invention preferably further comprises separating means for separating the guide means side end of the filament wire which is coiled around the mandrel wire between the guide means and the holding means to be formed into a coil from the guide means at a fixed distance, and is so constructed that the terminal means is another holding means to hold only the mandrel wire between the end of the filament wire and the guide means.

With such construction, a plurality of coils with fixed length and configuration can be formed continuously.

Further, the coil manufacturing apparatus of this invention is preferably so constructed that the separating means is a guide member located at the fixed distance from the guide means along the mandrel wire, whereby the filament wire delivered from the coiling means toward the mandrel wire is guided in its running direction.

With such construction, the structure of the separating means can be simplified.

Furthermore, the coil manufacturing apparatus according to an embodiment of this invention uses the forming knife to restart coiling of the filament wire around the mandrel wire for the formation of a new coils after the formation of the coil leg section. In the prior art coil manufacturing apparatus, on the other hand, the filament wire is coiled around the mandrel wire for the initial turn by holding the mandrel wire and the leg section of the filament wire in the vicinity of the guide means 12 by means of a pair of claws. Thus, the apparatus of the embodiment can prevent the damage to the leg section which may be caused with use of the prior art apparatus.

Although an illustrative embodiment of this invention has been described in detail herein, it is to be understood that the invention is not limited to such embodiment, and that various changes and modifications may be effected therein by one skilled in the art without departing from the scope or spirit of the invention.

For example, the first motor 58 may be a servomotor.

Figure 12:
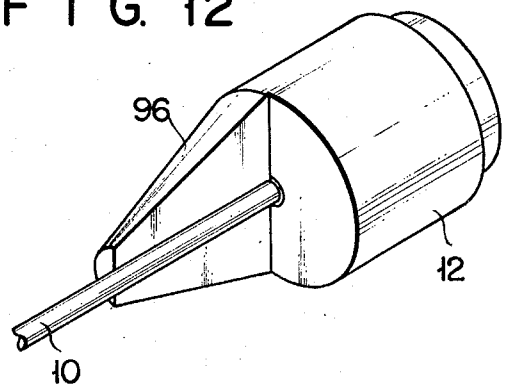
FIG. 12 is a perspective view showing a modification of separating means.

As shown in FIG. 12, moreover, the separating means may be a guide member 90 in the form of a half of a truncated cone with its base fixed to the guide means 12. The cut surface of the guide member 90 extends along the longitudinal direction of the core wire 10. The top of the guide member 90 is located at a fixed distance from the guide means 12 along the core wire 10, and the conical surface guides the filament wire in its running direction. The holding means 36 and the terminal means 72 hold the mandrel wire 10 and are electrically connected with the mandrel wire 10 between the top and base of the guide member 90.

Furthermore, the screw member 54 may be connected directly with the first motor 58 without using the clutch means 62. In this case, the omission of the clutch means leads to elimination of pitch error which may be caused by the influence of gear backlash, as well as to a reduction of components of the apparatus in number.

What we claim is:

1. A coil winding apparatus for manufacturing a wire coil having a leg portion at each end comprising:

a longitudinally moveable mandrel wire;

guide means operatively associated with said mandrel wire for guiding said mandrel wire during said longitudinal movement;

supply means for supplying filament wire to said mandrel wire and including means defining a filament wire feed path for feeding said filament wire to said mandrel wire between an initial position spaced from said mandrel wire to a final position downstream of said initial position, wherein said filament wire comes into contact with said mandrel wire at said final position;

coiling means operatively associated with said filament wire supply means for coiling said filament wire around said mandrel wire;

revolving means connected to said coiling means for revolving said coiling means around said mandrel wire between a coiling start time and a coiling end time;

means operatively connected to said revolving means for stopping said revolving means at said coiling end time;

leg forming means for forming said leg portion disposed between said initial and final positions of said filament wire feed path and reciprocably moveable between a starting position wherein said leg forming means is in a disengaged relationship with said filament wire and an end position wherein said leg forming means is in a filament wire engaging position to deflect said feed path and thus said filament wire towards said mandrel wire to lay said filament wire substantially parallel to said mandrel wire between said final position of said feed path and said end position of said leg forming means; and transfer means for longitudinally moving said mandrel wire and including first and second holding means for holding said mandrel wire, and driving means operatively connected to said first and second holding means and said leg forming means for (a) moving said first holding means into a holding relationship with said mandrel wire at said coiling start time, (b) longitudinally moving said first holding means while in said holding relationship at a predetermined rate of speed away from said guide means between a first position corresponding to said coiling start time and a second position downstream of said first position corresponding to said coiling end time, (c) stopping said longitudinal movement of said first holding means at said coiling end time, while (d) simultaneously moving said second holding means into a holding relationship with said mandrel wire upstream of said first holding means when said first holding means is at said second position, the coiled filament wire thereby being disposed between said first and second holding means, (e) releasing said first holding means from its holding relationship with said mandrel wire at said second position and moving said released first holding means in a direction towards said guide means to a third mandrel wire holding position upstream of and separated from said second holding means, (f) moving said leg forming means from said starting position to said end position when said first holding means is in said third mandrel wire holding position to form said leg portion and retaining said leg forming means in said end position until said coiling start time wherein it is moved from said end position to said starting position, and (g) releasing said second holding means from said holding relationship with said mandrel wire, whereby said first holding means is once again holding said mandrel wire at said coiling start time thereby permitting said transfer means to once again execute steps (a) through (g) to form a wire coil having a leg portion at each end.

2. A coil manufacturing apparatus according to claim 1 wherein said driving means includes a carriage member carrying said first holding means and variable-speed driving means for moving said carriage member from said coiling start time to said coiling end time at a variable-speed corresponding to the number of revolutions of said coiling means.

3. A coil manufacturing apparatus according to claim 1 or 2, wherein said first holding means, said mandrel wire and said second holding means are electrically conductive, said apparatus further comprising an electrical power source means electrically connected to said second holding means and said first holding means for supplying current along an electrical path including said second holding means, said first holding means, and said filament wire when said mandrel wire or said filament wire is electrically connected to said second holding means, thereby heat-treating the filament wire coiled around the mandrel wire between the second holding means and the first holding means so that working strain may be removed from the filament wire coiled around the mandrel coil.

4. A coil manufacturing apparatus according to claim 3, further comprising housing means for housing said filament wire coiled around said mandrel wire between said first holding means and said second holding means when said second holding means is electrically connected with said mandrel wire, and a gas supply means for supplying and filling said housing means with gas containing inert gas.

5. A coil manufacturing apparatus according to claim 4, wherein the gas contains hydrogen.

6. A coil manufacturing apparatus according to claim 3, wherein said supply means includes separating means for separating the filament wire from said guide means at a fixed distance corresponding to said initial position of said filament wire feed path.

7. A coil manufacturing apparatus according to claim 6, wherein said separating means is a guide member located at a fixed distance away from said guide means, whereby the filament wire delivered from said supply means toward said mandrel wire is guided in the direction of the longitudinal movement of said mandrel wire.

8. A coil manufacturing apparatus according to claim 7, further comprising housing means for housing said filament wire coiled around said mandrel wire between said first and second holding means when both of said first and second holding means are electrically connected with said mandrel wire, and a gas supply means for supplying and filling said housing means with gas containing inert gas.

9. A coil manufacturing apparatus according to claim 8, wherein the gas contains hydrogen.

* * * * *